US009743191B2

(12) United States Patent
Pal et al.

(10) Patent No.: US 9,743,191 B2
(45) Date of Patent: Aug. 22, 2017

(54) ACOUSTIC APPARATUS WITH DIAPHRAGM SUPPORTED AT A DISCRETE NUMBER OF LOCATIONS

(71) Applicant: Knowles Electronics, LLC, Itasca, IL (US)

(72) Inventors: Sagnik Pal, Schaumburg, IL (US); Sung Bok Lee, Chicago, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 14/873,816

(22) Filed: Oct. 2, 2015

(65) Prior Publication Data

US 2016/0105748 A1 Apr. 14, 2016

Related U.S. Application Data

(60) Provisional application No. 62/063,183, filed on Oct. 13, 2014.

(51) Int. Cl.

| | |
|---|---|
| ***H04R 25/00*** | (2006.01) |
| ***H04R 7/24*** | (2006.01) |
| ***H04R 19/00*** | (2006.01) |
| *H04R 7/12* | (2006.01) |
| *H04R 1/04* | (2006.01) |

(52) U.S. Cl.

CPC ..... *H04R 7/24* (2013.01); *H04R 19/005* (2013.01); *H04R 1/04* (2013.01); *H04R 7/122* (2013.01)

(58) Field of Classification Search

CPC ..... H04R 7/24; H04R 19/005; H04R 1/04; H04R 7/122

USPC ..... 381/174, 173, 150

See application file for complete search history.

(56) References Cited

U.S. PATENT DOCUMENTS

| | | | |
|---|---|---|---|
| 5,490,220 | A | 2/1996 | Loeppert |
| 5,870,482 | A | 2/1999 | Loeppert |
| 6,535,460 | B2 | 3/2003 | Loeppert |
| 6,847,090 | B2 | 1/2005 | Loeppert |
| 6,987,859 | B2 | 1/2006 | Loeppert |
| 7,023,066 | B2 | 4/2006 | Lee |
| 7,132,307 | B2 | 11/2006 | Wang |
| 7,190,038 | B2 | 3/2007 | Dehe et al. |

(Continued)

FOREIGN PATENT DOCUMENTS

| | | |
|---|---|---|
| EP | 1310136 | 3/2006 |
| EP | 1469701 | 4/2008 |

(Continued)

OTHER PUBLICATIONS

International Search Report and Written Opinion for PCT/US2015/054195 dated Jan. 20, 2016 (10 pages).

*Primary Examiner* — Sunita Joshi

(74) *Attorney, Agent, or Firm* — Foley & Lardner LLP

(57) ABSTRACT

An acoustic apparatus includes a back plate, a diaphragm, and at least one pillar. The diaphragm and the back plate are disposed in spaced relation to each other. At least one pillar is configured to at least temporarily connect the back plate and the diaphragm across the distance. The diaphragm stiffness is increased as compared to a diaphragm stiffness in absence of the pillar. The at least one pillar provides a clamped boundary condition when the diaphragm is electrically biased and the clamped boundary is provided at locations where the diaphragm is supported by the at least one pillar.

20 Claims, 8 Drawing Sheets

(56) References Cited

U.S. PATENT DOCUMENTS

| | | | | |
|---|---|---|---|---|
| 7,473,572 | B2 | 1/2009 | Dehe et al. | |
| 7,781,249 | B2 | 8/2010 | Laming et al. | |
| 7,795,695 | B2 | 9/2010 | Weigold et al. | |
| 7,825,484 | B2 | 11/2010 | Martin et al. | |
| 7,829,961 | B2 | 11/2010 | Hsiao | |
| 7,856,804 | B2 | 12/2010 | Laming et al. | |
| 7,903,831 | B2 | 3/2011 | Song | |
| 8,072,010 | B2 | 12/2011 | Lutz | |
| 9,107,008 | B2 | 8/2015 | Leitner | |
| 2005/0207605 | A1 | 9/2005 | Dehe et al. | |
| 2007/0160248 | A1 | 7/2007 | Sung | |
| 2007/0201710 | A1* | 8/2007 | Suzuki | B81B 3/0072 381/174 |
| 2007/0278501 | A1 | 12/2007 | MacPherson et al. | |
| 2008/0175425 | A1 | 7/2008 | Roberts et al. | |
| 2008/0267431 | A1 | 10/2008 | Leidl et al. | |
| 2008/0279407 | A1 | 11/2008 | Pahl | |
| 2008/0283942 | A1 | 11/2008 | Huang et al. | |
| 2009/0001553 | A1 | 1/2009 | Pahl et al. | |
| 2009/0180655 | A1 | 7/2009 | Tien et al. | |
| 2010/0046780 | A1 | 2/2010 | Song | |
| 2010/0052082 | A1 | 3/2010 | Lee et al. | |
| 2010/0128914 | A1 | 5/2010 | Khenkin | |
| 2010/0183181 | A1 | 7/2010 | Wang | |
| 2010/0246877 | A1 | 9/2010 | Wang et al. | |
| 2010/0270631 | A1 | 10/2010 | Renner | |
| 2010/0290644 | A1 | 11/2010 | Wu et al. | |
| 2010/0322443 | A1 | 12/2010 | Wu et al. | |
| 2010/0322451 | A1 | 12/2010 | Wu et al. | |
| 2011/0013787 | A1 | 1/2011 | Chang | |
| 2011/0075875 | A1 | 3/2011 | Wu et al. | |
| 2011/0216922 | A1 | 9/2011 | Li | |
| 2012/0056282 | A1 | 3/2012 | VanLippen | |
| 2012/0099753 | A1 | 4/2012 | vanderAvoort | |
| 2013/0142358 | A1 | 6/2013 | Schultz | |
| 2013/0243234 | A1* | 9/2013 | Zoellin | H04R 19/005 381/369 |
| 2013/0343580 | A1 | 12/2013 | Lautenschlager | |
| 2014/0084395 | A1 | 3/2014 | Sparks | |
| 2015/0237448 | A1 | 8/2015 | Loeppert | |
| 2015/0296305 | A1 | 10/2015 | Shao | |
| 2015/0296306 | A1 | 10/2015 | Shao | |
| 2015/0365770 | A1 | 12/2015 | Lautenschlager | |

FOREIGN PATENT DOCUMENTS

| | | |
|---|---|---|
| JP | 5049312 | 10/2012 |
| KR | 100722686 | 5/2007 |

* cited by examiner

ACOUSTIC APPARATUS WITH DIAPHRAGM SUPPORTED AT A DISCRETE NUMBER OF LOCATIONS

CROSS-REFERENCE TO RELATED APPLICATION

This patent claims benefit under 35 U.S.C. §119(e) to U.S. Provisional Application No. 62/063,183 entitled "Acoustic Apparatus with Diaphragm clamped at a Discreet Number of Locations" filed Oct. 13, 2014, the content of which is incorporated herein by reference in its entirety.

TECHNICAL FIELD

This application relates to acoustic devices and, more specifically, to MEMS microphones.

BACKGROUND OF THE INVENTION

Different types of acoustic devices have been used through the years. One type of device is a microphone. In a microelectromechanical system (MEMS) microphone, a MEMS die includes a diaphragm and a back plate. The MEMS die is supported by a base and enclosed by a housing (e.g., a cup or cover with walls). A port may extend through the base (for a bottom port device) or through the top of the housing (for a top port device) or through the side of the housing (for a side port device). In any case, sound energy traverses through the port, deforms the diaphragm and creates a changing electrical capacitance between the diaphragm and the back-plate, which creates an electrical signal. Microphones are deployed in various types of devices such as personal computers, cellular phones and tablets.

One type of a MEMS microphone utilizes a free plate diaphragm. The biased free plate diaphragm typically sits on support posts located along the periphery of the diaphragm. The support posts restrain the movement of the diaphragm. Free plate diaphragms tend to have a high mechanical compliance. Consequently, designs that utilize free plate diaphragms may suffer from high total harmonic distortion (THD) levels, particularly when operating at high sound pressure levels (SPLs).

All of these problems have resulted in some user dissatisfaction with previous approaches.

BRIEF DESCRIPTION OF THE DRAWINGS

For a more complete understanding of the disclosure, reference should be made to the following detailed description and accompanying drawings wherein.

Figure 1:
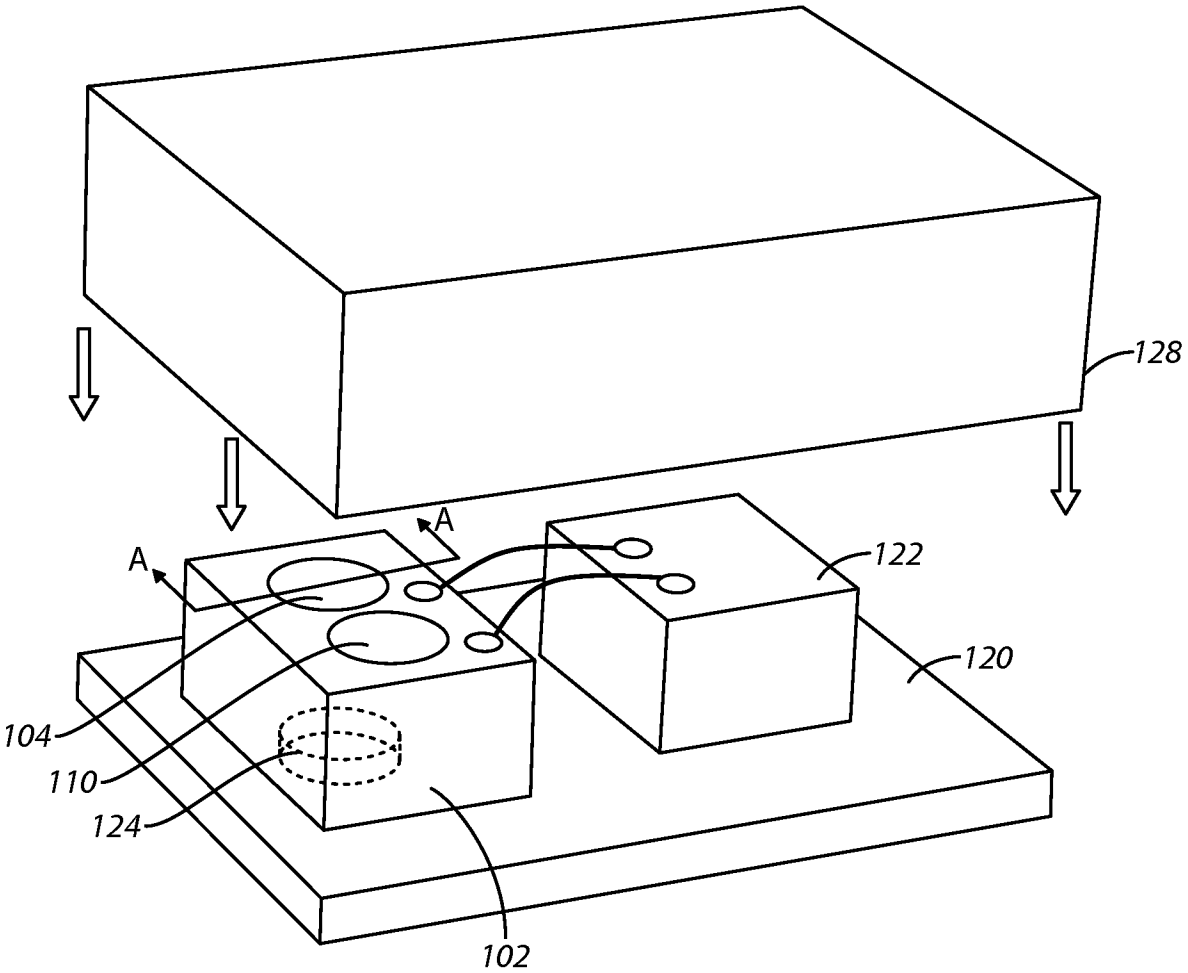
FIG. 1 comprises a perspective cut-away drawing of a portion of a microphone apparatus according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

In the present approaches, a microelectromechanical system (MEMS) apparatus with a center clamped diaphragm is provided. Such devices provide greater linearity and lower THD compared to previous free plate approaches. More specifically and in some aspects, a central pillar connects the diaphragm center of one or more diaphragms to the back plate center. The central pillar advantageously approximates a clamped boundary condition at the diaphragm center thereby increasing diaphragm stiffness. In some embodiments, the central pillar also provides an electrical connection to the diaphragm thereby eliminating the need for a separate diaphragm runner that is used (and typically required) in previous approaches. In some embodiments, the pillar may be located at an offset with respect to the diaphragm center.

In other aspects and when the diaphragm is biased, the diaphragm is tensioned as it is pulled against the posts by the electrostatic field established by the bias. Additionally, certain regions of the diaphragm assume a doubly-curved shape upon bias. One or both of the tensioning and the doubly-curved shape result in increased stiffness of the diaphragm and improved linearity of operation such that the relationship between the input signal of the microphone and the output signal of the microphone has very low nonlinearity.

Referring now to FIG. 1-4, a microphone apparatus 100 is described. A MEMS device 102 includes a first motor 104 (including a first diaphragm 106 and a first back plate 108) and a second motor 110 (including a second diaphragm and a second back plate both not shown). It will be appreciated that the detailed description herein relates only to the first motor, but that this description applies equally to the second motor.

Referring now especially to FIG. 1, the MEMS device 102 is disposed on a base 120. Also disposed on the base 120 and coupled to the MEMS device 102 is an application specific integrated circuit (ASIC) 122. Port 124 extends through the base 120 and allows sound energy to be received by the motors in the MEMS device 102. A cover 128 is disposed on top of the base 120. It will be appreciated that this is a bottom port device, but it will be understood that ports could alternatively extend through the cover 128 and the device would become a top port device or a side port device depending on port location.

In operation, sound energy is received by the two motors 104 and 110 in the MEMS device 102 via ports 124. The motors 104 and 110 in the MEMS device 120 convert the sound energy into electrical signals. The electrical signals are then processed by the ASIC 122. The processing may include, for example, attenuation or amplification to mention two examples. Other examples are possible. The processed signals are then transmitted to pads (not shown) on the base 120, which couple to customer devices. For example, the apparatus 100 may be incorporated into a cellular phone, personal computer, or tablet and the customer devices may be devices or circuits associated with the cellular phone, personal computer, tablet, or other device.

Turning now to a description of the central pillar arrangement, it will be appreciated that this discussion is with respect to the first motor 104. However, it will be appreciated that the structure of the arrangement of the second motor 110 may be identical to the description of the first motor 104.

Figure 2:
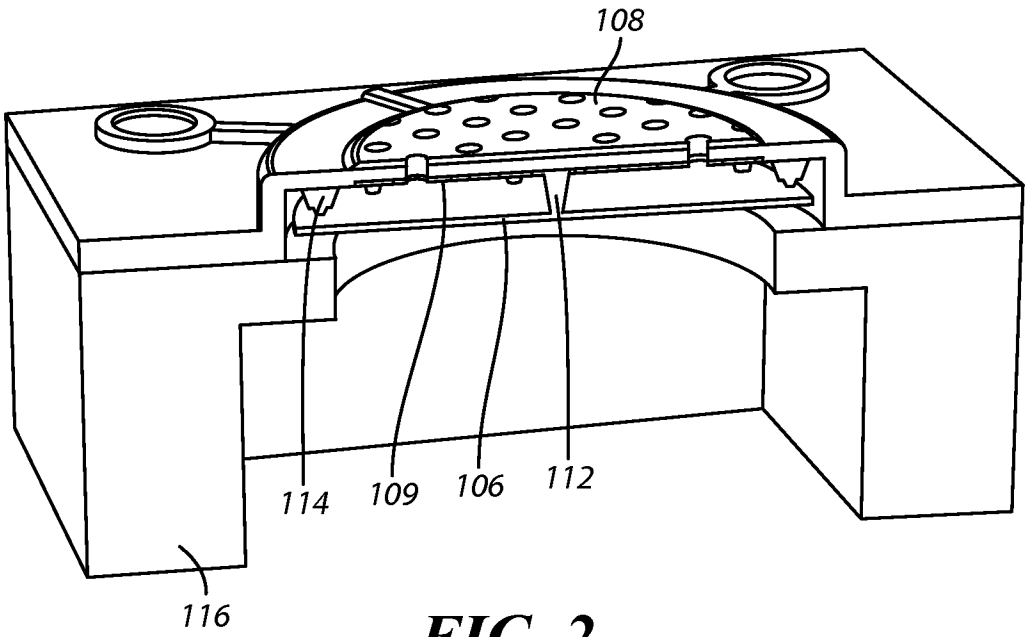
FIG. 2 comprises a perspective cut-away drawing of a portion of a microphone apparatus taken along line A-A in FIG. 1 according to various embodiments of the present invention.
Figure 3:
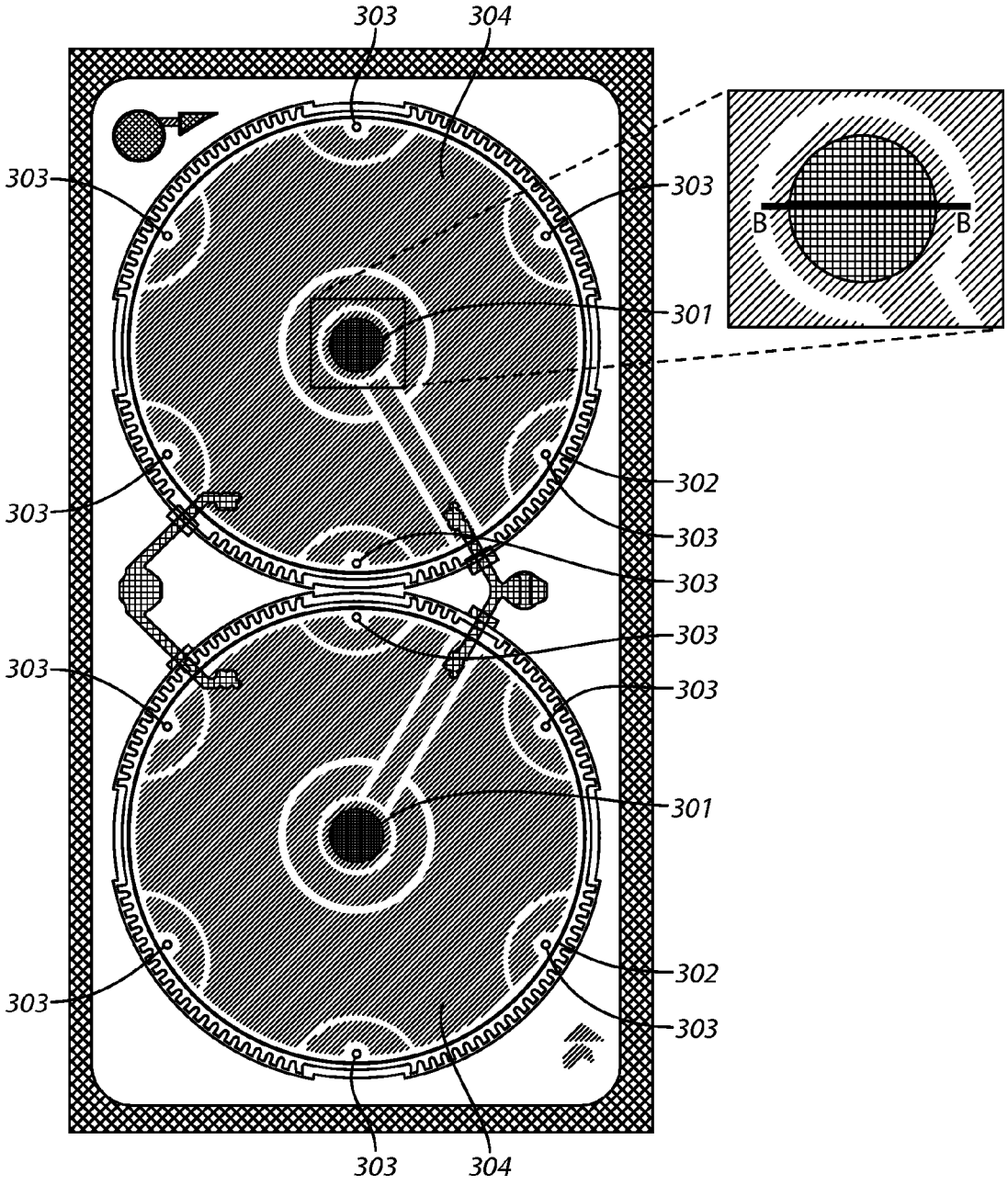
FIG. 3 comprises a top view of the microphone apparatus of FIGS. 1 and 2 according to various embodiments of the present invention.
Figure 4:
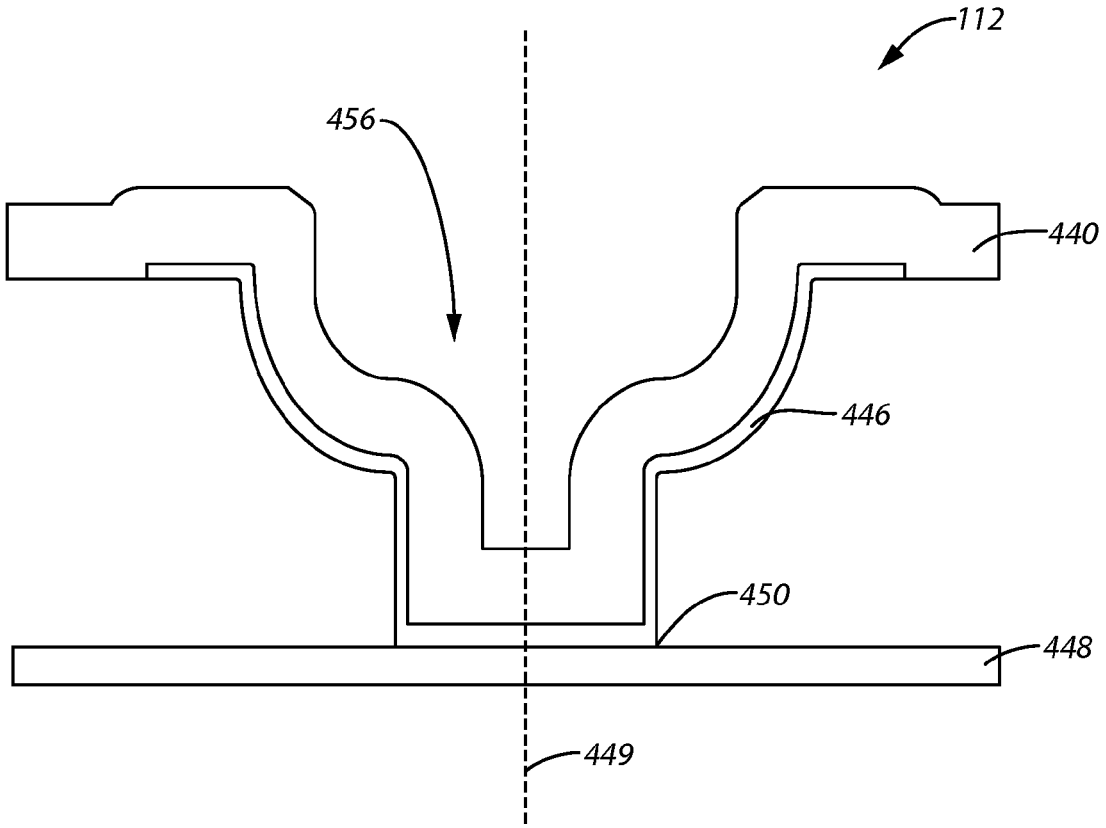
FIG. 4 comprises a side cutaway view of the center part of the apparatus of FIG. 3 along line B-B according to various embodiments of the present invention.

Referring now especially to FIG. 2, FIG. 3 and FIG. 4, the first motor 104 includes a central pillar 112 that connects the back plate 108 to the diaphragm 106. Typically, the back plate 108 consists of an electrically conductive back plate electrode 109, and one or more structural materials. The diaphragm 106 and the back plate electrode 109 form an electrical capacitor. Posts 114 constrain the movement of the diaphragm 106 at a periphery of the diaphragm 106. In one example, the posts 114 are constructed of silicon nitride and approximately 6 posts are utilized. This number is significantly less than previous approaches that utilize a free-plate diaphragm. FIG. 3 shows a top-view layout schematic of a MEMS die with two motors. The diaphragms 302 are attached to the pillar 301. Each motor has six posts 303. The star-like shape 304 represents the back-plate electrode. The back-plate electrodes 304 and the diaphragms 302 form the working capacitance of the MEMS. The star-shaped electrode 304 maximizes the working capacitance of the MEMS and provides improved signal-to-noise ratio compared to circular or donut shaped electrodes. Other construction materials and numbers of posts and pillars may also be used. Some embodiments may have one or more pillars and no posts. Some examples may have one or more pillars and one or more posts. In some embodiments, the back-plate electrode may not be star-shaped. A side-view cross-section along the line BB in FIG. 3 is shown in FIG. 4. Referring now to FIG. 4, the central pillar 112 is described in detail. The central pillar 112 includes a silicon nitride layer 440 and polysilicon layer 446. Polysilicon layer 448 forms the diaphragm 106. In this embodiment, the polysilicon and silicon nitride deposition steps that form the pillar also form the back-plate. Consequently, the central pillar is, in this example, formed integrally with the back plate 108 and is physically connected to the diaphragm 106. However, it will be understood that in other embodiments the central pillar can be formed only with the diaphragm material, only with the back plate material, or that all three elements are formed separately. Together, these elements form a central pillar having a hollow area 456. It will be appreciated that this is one example of the configuration of a central pillar and that other examples are possible. In this example, the pillar is axisymmetric about the central axis 449. In other embodiments, the pillar need not be axisymmetric. In certain embodiments, the pillar may be solid or it may have a cage-like structure formed with multiple segments. In this example, a sharp angle 450 exists at the pillar-diaphragm interface. In other embodiments, the pillar-diaphragm junction and/or the pillar-back plate junction may be chamfered and/or filleted. Chamfering and/or filleting are expected to make the structure robust, so that it can better withstand airburst events.

So configured, the central pillar 112 advantageously approximates a clamped boundary condition at the center of the diaphragm 106 thereby increasing diaphragm stiffness. The central pillar 112 also provides an electrical connection to the diaphragm 106 thereby eliminating the need for a separate diaphragm runner that was used in previous approaches to implement electrical connection to the diaphragm. However, in other embodiments, the pillar may be used for providing clamped boundary condition only, and electrical connection to the diaphragm may be implemented by other approaches.

Figure 7:
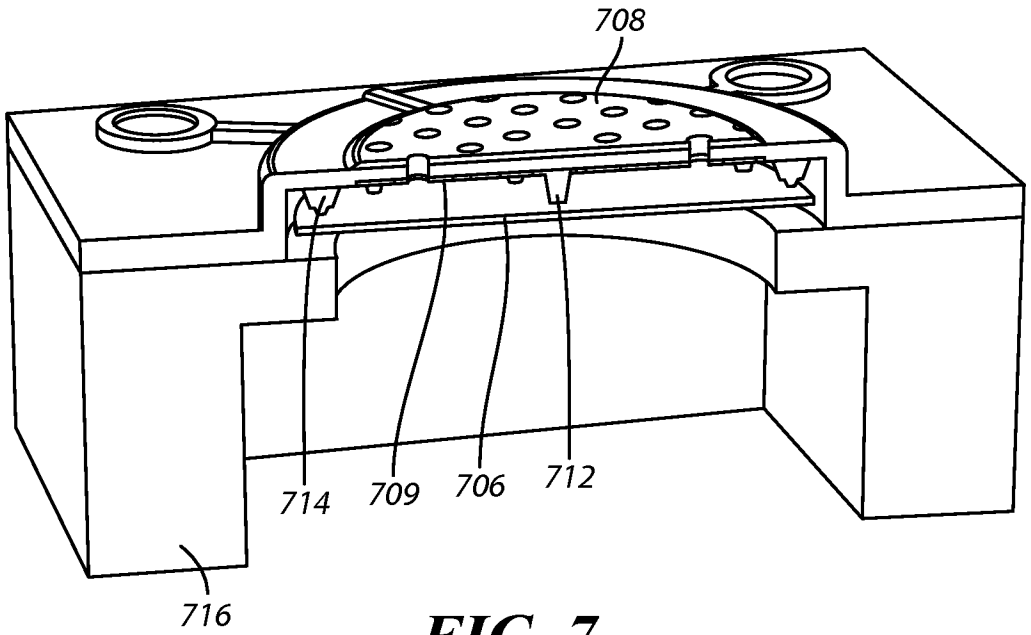
FIG. 7 comprises a perspective cut-away drawing of a portion of another example of a microphone apparatus taken along line A-A in FIG. 1 according to various embodiments of the present invention.

In yet another example, the unbiased diaphragm may not be physically attached to the pillar as shown in FIG. 7; a bias applied between the diaphragm and the back-plate may be used to pull the diaphragm against the pillar, thereby approximating a clamped boundary condition in the diaphragm-pillar contact region.

When an electrical bias is applied between the diaphragm 106 and the back plate electrode 109, the diaphragm is tensioned due to the reduced number of posts that are utilized. Additionally, certain regions of the diaphragm 106 assume a doubly-curved shape upon bias. One or both of the tensioning and the doubly curved shape result in increased stiffness of the diaphragm 106 and improved linearity of operation such that a nearly linear relationship exists between the input signal of the microphone and the output signal of the microphone 100.

Figure 5A:
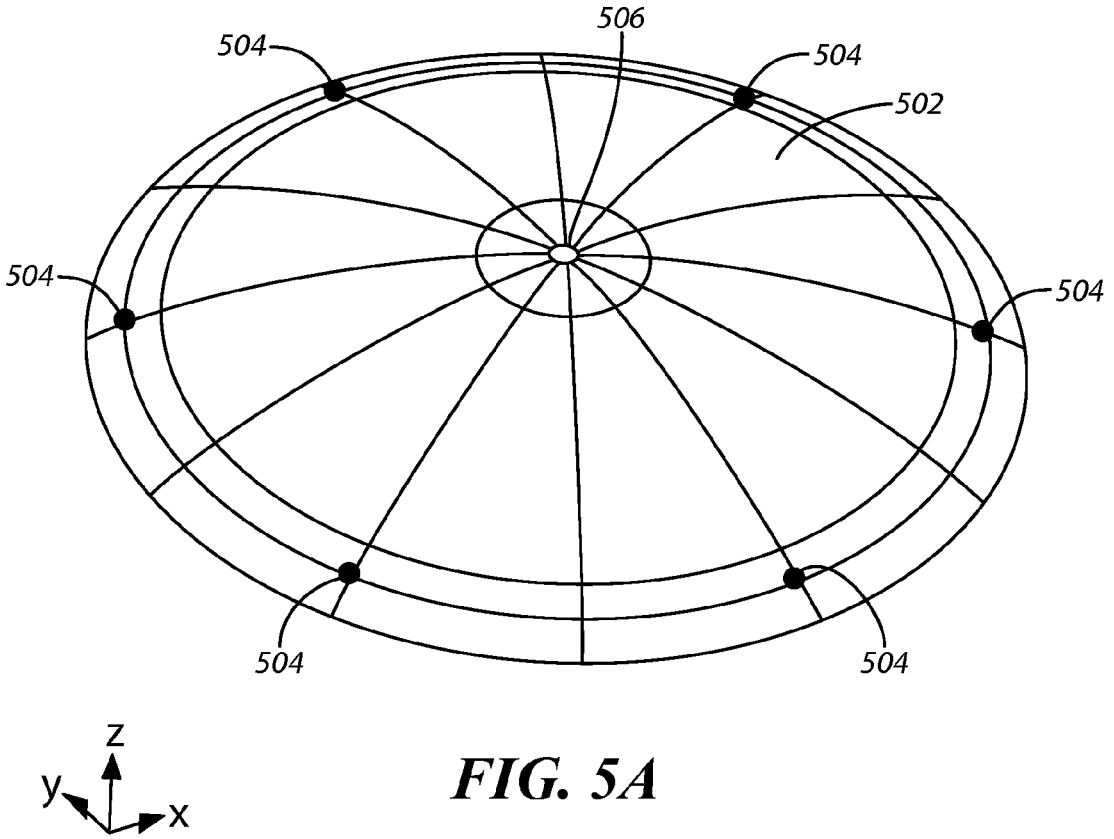
FIGS. 5A-B comprises a graph showing some of the aspects of the operation of the microphone of FIG. 1-4 according to various embodiments of the present invention.
Figure 5B:
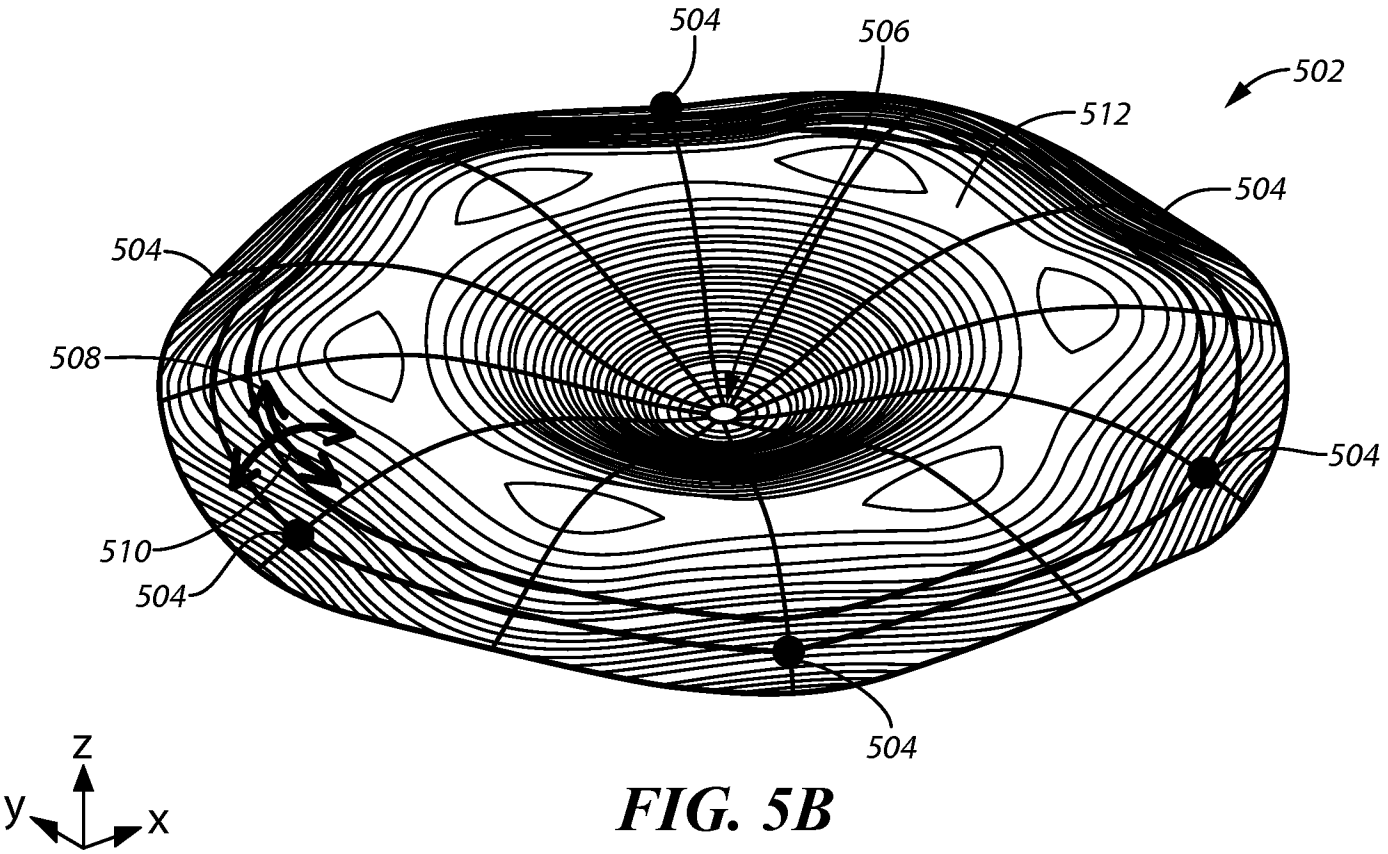

Referring now to FIGS. 5A-B, various graphs showing some of the aspects of the operation of the microphone, is described. The graph 5A shows a diaphragm 502 when unbiased (no electrical bias applied between the diaphragm 106 and the back plate electrode 109). It can be seen that the diaphragm 502 is domed shaped. The graph in FIG. 5B shows deflection of the diaphragm 502, around peripheral posts. The impact point between the diaphragm 502 and the posts are labeled 504. The diaphragm 502 is held by the center clamp 506. FIG. 5B depicts the diaphragm shape when an electrical bias is applied between the diaphragm 106 and the back plate electrode 109. As mentioned, a stiffer diaphragm is provided by the approaches provided herein. When an electrical bias is applied between the diaphragm 106 and the back plate electrode 109, the diaphragm is tensioned and doubled curved. In FIG. 5B, the double curves are indicated by the arrows labeled 508 and 510. Instead of a single maximum deflection point, the present approaches provide a maximum deflection region around a donut-like region 512 (that is present between the center clamp and the peripheral posts and is shaped by the curves 508 and 511). This resultant configuration compensates for all or much of the sensitivity lost due to increased stiffness of the diaphragm.

As has also been mentioned, the central clamp can also be used as an electrical connection to the diaphragm and this helps with improved miniaturization.

Figure 6:
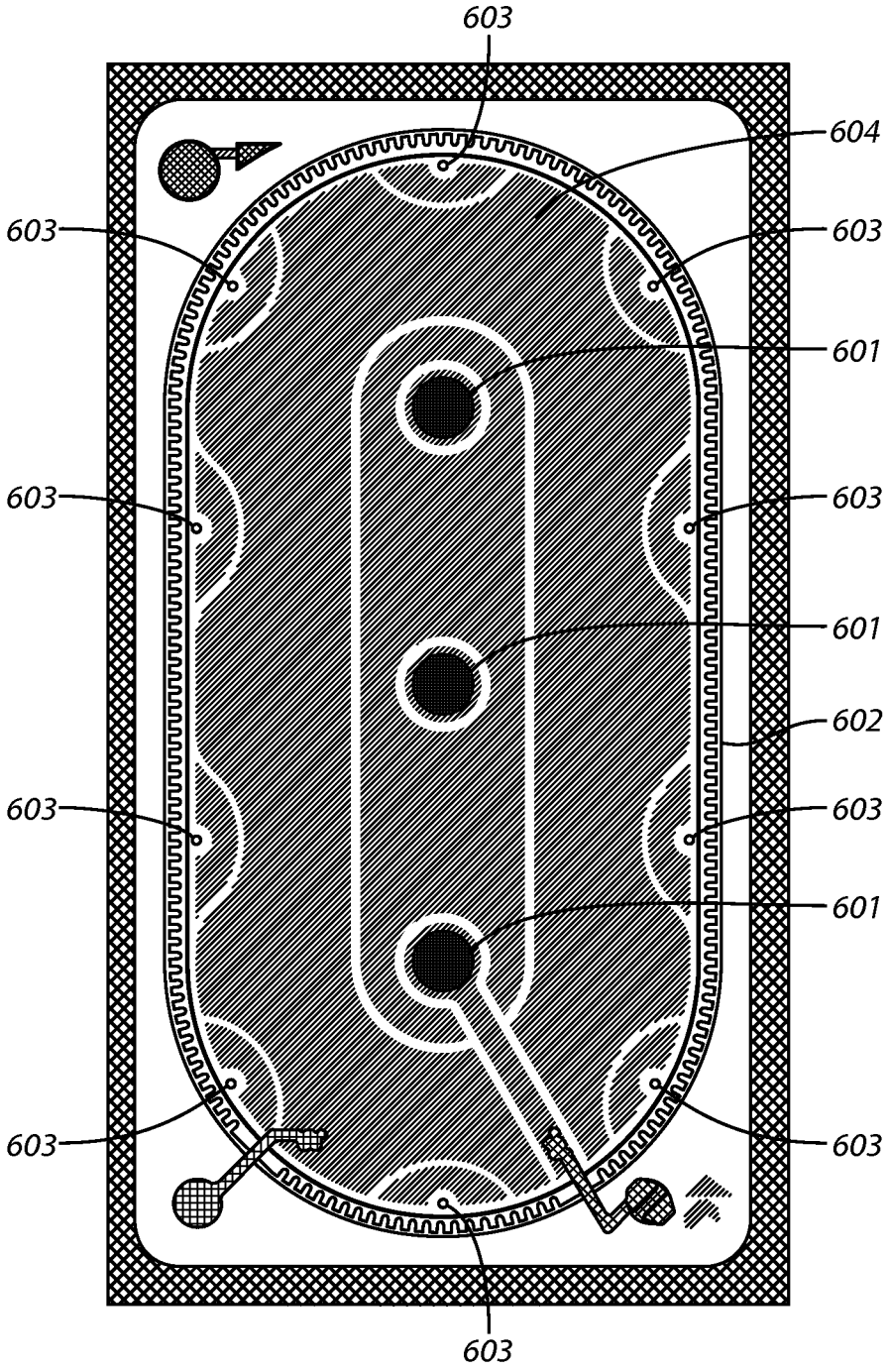
FIG. 6 comprises a top view of the microphone apparatus of FIGS. 1 and 2 demonstrating an embodiment with non-circular diaphragm and multiple pillars according to various embodiments of the present invention.

The pillar may not be located at the center of the diaphragm. Moreover, there may be multiple pillars within a single motor. FIG. 6 comprises a top view of the microphone apparatus of FIGS. 1 and 2 demonstrating an example of an apparatus with a non-circular diaphragm 602 and multiple pillars 601. In this example, there are ten posts 603, three pillars 601, and the non-circular diaphragm 602 maximizes MEMS die area utilization, thereby improving signal-to-noise ratio per unit die area.

Embodiments that utilize a capacitive transduction mechanism have been described, however transduction modes such as piezoresistive, piezoelectric, and electromagnetic transduction are also possible. Other modes of transduction are also possible.

Referring now to FIG. 7, another example of a motor structure is described. The example of FIG. 7 is similar to the example of FIG. 2 and like-numbered elements in FIG. 2 correspond to like numbered elements in FIG. 7. In the example of FIG. 7, the first motor 704 includes a central pillar 712 that connects the back plate 708 to the diaphragm 706. However, in contrast to FIG. 2 in the example of FIG. 7 the central pillar 712 is formed separately and is not permanently connected to diaphragm 706. The back plate 708 consists of an electrically conductive back plate electrode 709, and one or more structural materials. The diaphragm 706 and the back plate electrode 709 form an electrical capacitor. Posts 714 constrain the movement of the diaphragm 706 at a periphery of the diaphragm 706. In one example, the posts 714 are constructed of silicon nitride and approximately 6 posts are utilized. Other examples are possible.

It will be appreciated that in some aspects with the central pillar arrangements described herein, the central pillar can be offset from a central axis. In other aspects, multiple pillars can be used as shown in FIG. 6.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. An acoustic apparatus, comprising:

a back plate;

a diaphragm, the diaphragm and the back plate being disposed in spaced relation to each other and separated by a distance;

at least one pillar configured to connect the back plate and the diaphragm; and a plurality of posts extending out of the back plate towards the diaphragm and along the periphery of the diaphragm, wherein the at least one pillar is disposed in a spaced relationship with the plurality of posts, wherein under electric bias, a portion of the diaphragm disposed adjacent to an area of the back plate between the at least one pillar and the plurality of posts is closer to the back plate than portions of the diaphragm in contact with the plurality of posts and to the at least one pillar.

2. The acoustic apparatus of claim 1, wherein the diaphragm generally circular in shape with an axis extending orthogonally to the center of the diaphragm and through the back plate.

3. The acoustic apparatus of claim 2, wherein the at least one pillar is formed about the axis and configured to at least temporarily connect the back plate and the diaphragm.

4. The acoustic apparatus of claim 1, wherein the at least one pillar comprises multiple pillars.

5. The acoustic apparatus of claim 1, wherein the diaphragm and the at least one pillar are integrally formed together.

6. The acoustic apparatus of claim 1, wherein the diaphragm and the at least one pillar are formed separately.

7. The acoustic apparatus of claim 6, wherein the at least one pillar is connected to a separate back plate.

8. The acoustic apparatus of claim 1, wherein the at least one pillar provides an electrical connection between the back plate and the diaphragm.

9. The acoustic apparatus of claim 1, wherein the portion of the diaphragm adjacent to the area of the back plate between the at least one pillar and the plurality of posts assumes a double curved shape.

10. The acoustic apparatus of claim 1, wherein the diaphragm is formed of polysilicon.

11. The acoustic apparatus of claim 1, wherein the at least one pillar includes silicon nitride layer and polysilicon layer.

12. The acoustic apparatus of claim 1, wherein the at least one pillar is generally axisymmetric.

13. The acoustic apparatus of claim 1, wherein the at least one pillar is non-axisymmetric.

14. A acoustic apparatus, comprising:

a back plate;

a diaphragm disposed in spaced relation to, and separated by a distance from, the back plate;

a plurality of posts extending out of the back plate towards the diaphragm and along the periphery of the diaphragm; and at least one pillar extending out of the back plate towards the diaphragm and configured to detachably connect the back plate and the diaphragm, wherein the at least one pillar is disposed in a spaced relationship with the plurality of posts, wherein under electric bias, a portion of the diaphragm disposed adjacent to an area of the back plate between the at least one pillar and the plurality of posts is closer to the back plate than portions of the diaphragm in contact with the plurality of posts and to the at least one pillar.

15. The acoustic apparatus of claim 14, wherein the diaphragm is generally circular in shape with an axis extending orthogonally to the center of the diaphragm and through the back plate.

16. The acoustic apparatus of claim 14, wherein the at least one pillar comprises multiple pillars.

17. The acoustic apparatus of claim 14, wherein the at least one pillar provides an electrical connection between the back plate and the diaphragm.

18. The acoustic apparatus of claim 14, wherein the portion of the diaphragm adjacent to the area of the back plate between the at least one pillar and the plurality of posts assumes a double curved shape.

19. The acoustic apparatus of claim 14, wherein the at least one pillar is generally axisymmetric.

20. The acoustic apparatus of claim 14, wherein the at least one pillar is non-axisymmetric.

* * * * *